United States Patent [19]

Driver

[11] 4,160,882

[45] Jul. 10, 1979

[54] DOUBLE DIAPHRAGM ELECTROSTATIC TRANSDUCER EACH DIAPHRAGM COMPRISING TWO PLASTIC SHEETS HAVING DIFFERENT CHARGE CARRYING CHARACTERISTICS

[76] Inventor: Michael L. Driver, 3658 N. Fair Oaks Ave., Altadena, Calif. 91001

[21] Appl. No.: 885,642

[22] Filed: Mar. 13, 1978

[51] Int. Cl.[2] ..... H04R 19/02

[52] U.S. Cl. ..... 179/111 R

[58] Field of Search ..... 179/111 R, 111 E

[56] References Cited

U.S. PATENT DOCUMENTS

| | | | |
|---|---|---|---|
| 2,863,953 | 12/1958 | Reed et al. | 179/111 R |
| 3,118,979 | 1/1964 | Sessler et al. | 179/111 R |
| 3,345,469 | 10/1967 | Rod | 179/111 R |
| 3,632,903 | 1/1972 | Lange, Jr. | 179/111 R |
| 3,821,490 | 6/1974 | Bobb | 179/111 R |
| 3,935,397 | 1/1976 | West | 179/111 R |

FOREIGN PATENT DOCUMENTS

| | | | |
|---|---|---|---|
| 529978 | 7/1931 | Fed. Rep. of Germany | 179/111 R |
| 1375246 | 9/1964 | France | 179/111 R |
| 1465963 | 12/1966 | France | 179/111 R |
| 801352 | 9/1958 | United Kingdom | 179/111 R |
| 838023 | 6/1960 | United Kingdom | 179/111 R |

*Primary Examiner*—George G. Stellar

*Attorney, Agent, or Firm*—William W. Haefliger

[57] ABSTRACT

An electrostatic transducer, such as a loudspeaker, employs parallel plastic diaphragms, each carrying an electrically conductive metallic layer; frames separately mounting the diaphragms, the frames assembled to a central, perforate electrically conductive sheet sandwiched between the diaphragms, and to foraminous sheets of dielectric material sandwiched between the central sheet and the diaphragms and frames, thereby to realize a compact, easily assembled unit characterized by very high performance qualities.

11 Claims, 5 Drawing Figures

DOUBLE DIAPHRAGM ELECTROSTATIC TRANSDUCER EACH DIAPHRAGM COMPRISING TWO PLASTIC SHEETS HAVING DIFFERENT CHARGE CARRYING CHARACTERISTICS

BACKGROUND OF THE INVENTION

This invention relates generally to electrostatic transducers such as loudspeakers, and more particularly concerns substantial improvements in the construction, mode of operation and performance of such speakers.

Various forms of electrostatic loudspeakers have been proposed for many years and in some instances have been commercially marketed. Perhaps the most familiar of the commercially available electrostatic loudspeakers is that developed by A. A. Janszen described in U.S. Pat. No. 2,631,196 and in U.S. Pat. No. 2,896,025. The Janszen speaker comprises an arrangement in which a flexible diaphragm or membrane is mounted between fixed electrodes in the form of a grid of wires. The wires are spaced apart so as to enable sound waves generated by movement of the flexible diaphragm to be emitted. The wires are sheathed in a dielectric insulation material and the flexible membrane bears a coating of a highly resistive material. By means of an open latticed frame, the membrane is suspended between the electrode wires and clamped in position by dividers of the lattice so that in operation relatively small segments of the diaphragm are enabled to vibrate under the influence of electrostatic fields acting upon the diaphragm.

The Janszen speaker and other known electrostatic speakers require the application of a relatively high polarizing voltage between the flexible diaphragm and the wire grid electrodes for their operation. In order to operate with a constant charge they additionally require a relatively high series resistor between the source of polarizing voltage and the electrodes. Due to the configuration of the known speakers the electrical capacity is relatively low, and due to the presence of the highly resistive coating on the flexible diaphragm they possess a relatively low efficiency in converting applied electrical signals to audible sound waves. However, perhaps the most serious deficiency of the Janszen speakers and all other previously known electrostatic speakers either proposed or commercially available is that their characteristics of relatively low capacity, relatively low efficiency, mechanical size and configuration, relatively small segments of vibrating diaphragm area and resistive coatings lead to an inability to adequately reproduce relatively low sound frequencies. Accordingly, in most instances known electrostatic speakers have been used to reproduce only the mid-range and higher audible frequencies requiring that they be employed in conjunction with a base frequency speaker sometimes known as a "woofer."

Other examples of electrostatic speakers in the prior art may be found in the patents of D. T. N. Williamson et al U.S. Pat. Nos. 3,008,013 and 3,008,014, Malme U.S. Pat. No. 3,014,098 and an article entitled "Electrostatic Speakers" by George W. Tillet appearing in "Audio Magazine" for March of 1971 at page 52 et seq. and an article by P. J. Walker appearing in parts in "Wireless World" for May, June and August of 1955. However, none of the known prior art speakers possess the advantages and improved operating characteristics of the present invention.

SUMMARY OF THE INVENTION

It is a major object of the invention to provide an inexpensive, full dynamic range, high quality loudspeaker characterized as over-coming the deficiencies of the above described prior art speakers, and as also providing a number of advantages in construction, mode of operation and results, as will be seen. Basically, the speaker comprises, in combination:

(a) a pair of spaced, generally parallel diaphragms each of which includes a first sheet of plastic material and an electrically conductive layer adherent to said sheet, (b) a pair of frames respectively peripherally mounting said diaphragms, the frames extending in parallel, spaced apart relation, (c) a perforate, electrically conductive sheet sandwiched between said diaphragms, and (d) foraminous sheets of dielectric material sandwiched between said perforate sheet and said diaphragms, (e) whereby the diaphragms remain acoustically coupled through the foraminous dielectric sheets and through the perforate, electrically conductive sheet for simultaneous vibratory excursions when an AC signal is applied across the electrically conductive layers and the perforate sheet is connected to a common potential.

Further, and as will appear, the first sheets may consist of polyester films; the diaphragms may include second sheets of plastic material such as vinylidene chloride and the peripheries of the diaphragm may be peripherally wrapped about mounting frames to develop tautness in the free central portions of the diaphragms; the foraminous sheets may consist of spun glass net with woven strand configuration; and the components may be held in stacked relation by peripheral taping. Further, the loudspeakers may be mounted in pairs in a cabinet with acoustically open front and backsides; and a simple, one transformer circuit may couple the loudspeaker to an AC source, as will be seen.

These and other objects and advantages of the invention, as well as the details of an illustrative embodiment, will be more fully understood from the following description and drawings, in which:

DRAWING DESCRIPTION

FIG. 2 is a reduced size front view of the FIG. 1 speaker, viewed on lines 2—2 of FIG. 1;

DETAILED DESCRIPTION

Figure 1:
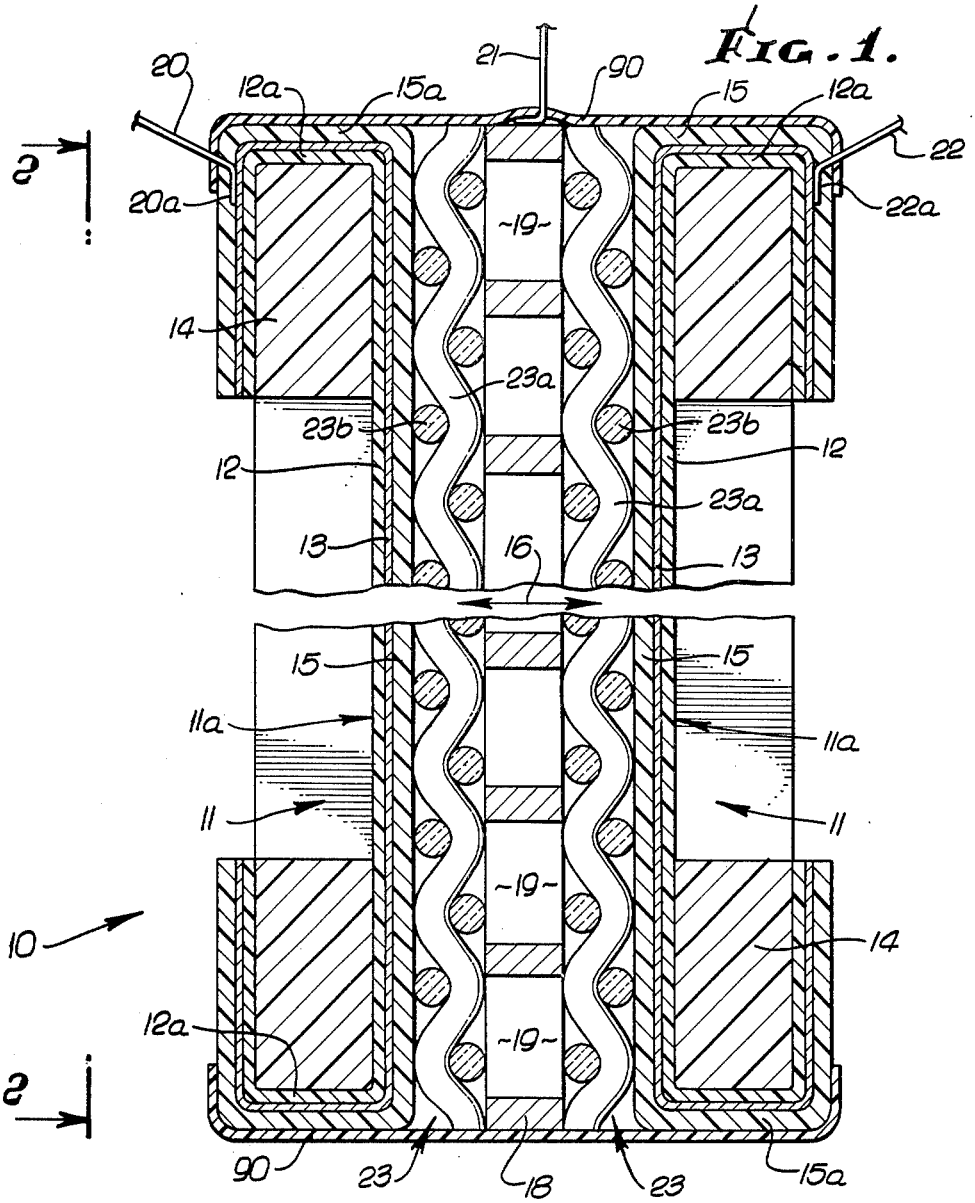
FIG. 1 is an enlarged vertical section taken through a speaker constructed in accordance with the invention.

In FIGS. 1 and 2, loudspeaker 10 is shown to comprise a pair of spaced, generally parallel diaphragms 11, each of which includes a first sheet 12 of plastic material, and an electrically conductive layer 13 adherent to that sheet. Typically, each sheet 12 consists of polyester film of about 0.00025 inch thickness, and is peripherally wrapped at 12*a* over a supporting frame 14 of insulative material. Frames 14 are shown as generally rectangular, in FIG. 2, and as extending in parallel, spaced apart relation, in FIG. 1. The layer 13 may consist of a metallized layer on sheet 12, and also wrapped about the frame.

Each diaphragm may also include a second sheet 15 of plastic material at the opposite side of layer 13. Sheet 15 is also peripherally wrapped at 15*a* about the frame, and the diaphragm is typically stretched by such wrapping so that the free extent 11*a* of the diaphragm inwardly of the frame is in taut condition, free to oscillate back and forth in the direction of arrows 16 in FIG. 1. The tension exertion on each diaphragm is a minimum of about 10 inch ounces.

The sheets 12 and 15 respectively and advantageously consist of polyester and vinylidene chloride, both being films and of respective thicknesses of about 0.00025 inch and 0.0015 inch.

Polyester film carries a low level static charge, owing to its chemical composition, which is employed to advantage in the final mill rolling or winding of the film. Static charges can be placed on polyester film readily by rubbing or brushing with dissimilar material. Such charges, however, migrate at random and dissipate rather quickly. Vinylidene chloride carries a relatively larger static charge on a permanent basis; it adheres to itself readily, and is widely sold and used under the trade name "SARAN." Also, in a flame test, vinylidene chloride is self-extinguishing.

When placed in close relation with polyester film, and operated as a capacitive transducer, the vinylidene chloride film causes the capacitive junction to exhibit self-healing characteristics when driven to the point where arcing or high voltage corona occurs.

The loudspeaker assembly also includes a perforate, electrically conductive plate 18, as for example an aluminum plate, containing a regular pattern of through passages 19 over its length and width. The plate extends centrally of the diaphragm, and parallel thereto. Wires 20, 21 and 22 are respectivey connected with layer 13 on one diaphragm, plate 18 and layer 13 on the other diaphragm, as shown in FIG. 1. Such connections 20*a* and 22*a* are made adjacent to the rigid frames, for stability.

Also included in the loudspeaker assembly are foraminous sheets 23 of dielectric material sandwiched between sheet 18 and the two diaphragms 11. Each sheet 23 may advantageously consist of spun glass net, with warp and woof strands 23*a* and 23*b* as shown. Sheets 23 are substantially thicker than sheets 15, and may typically be about 0.0075 inch in thickness. As a result, the diaphragms remain acoustically coupled through the foraminous sheets 23 and through the perforate plate 18, for simultaneous vibratory excursions in the direction of arrows 16 when an AC signal is applied across leads 20 and 22, and perforate sheet or plate 18 is connected to a common potential. Tape 90 holds the parts together.

Figure 3:
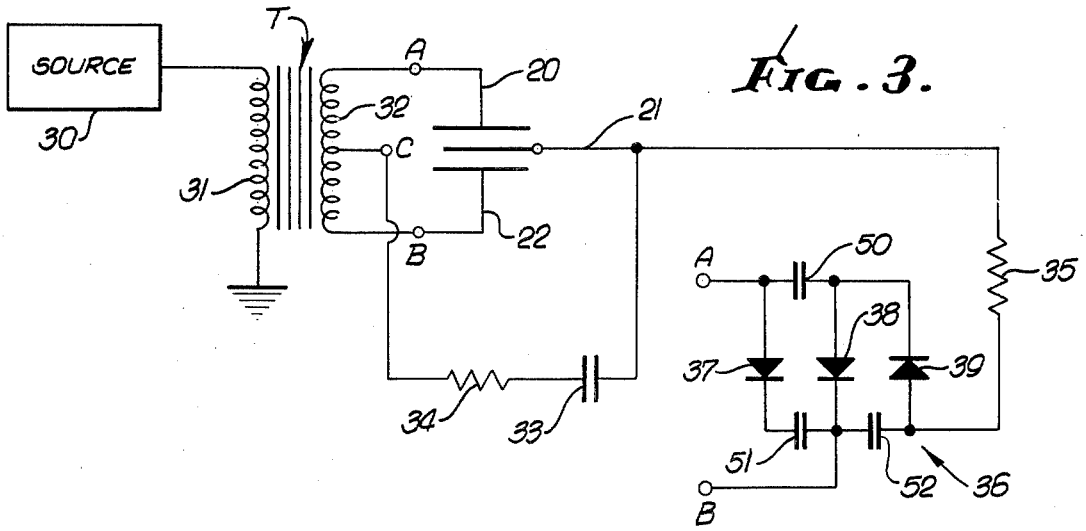
FIG. 3 is a circuit diagram.
Figure 3:
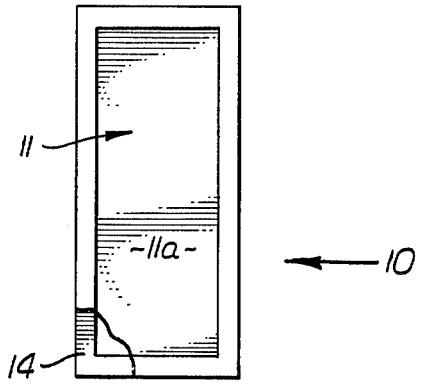

FIG. 3 shows a typical circuit in which the loudspeaker of FIG. 1 is connected. An audio signal from a source 30 is applied to winding 31 of transformer T. The leads 20 and 22 previously described are connected at A and B across the transformer secondary winding 32, and the loudspeaker is driven in push-pull relation. Lead 21 is connected via capacitor 33 and resistor 34 with center tap C of winding 32. Also, lead 21 is connected via resistor 35 with capacitance-diode network 36, to which points A and B are suitably connected, as shown. Network 36 includes diodes 37–39, and capacitors 50–52, as shown. As a result, a common source of audio alternating current serves to drive the transducer and to supply rectified potential to plate 18, obviating the need for a second transformer.

In addition, a natural charge (carried by the vinylidene chloride film 15) develops between the two plastic films 15 and 12. When this charge is further enhanced by the bias voltage from the network circuit, the internal impedance drops and it becomes a highly efficient transducer; so efficient that while prior art devices typically use impedance matching transformers with 100 to 1 turns ratio, this transducer operates with an impedance matching transformer whose turns ratio is 18 to 1.

Figure 4:
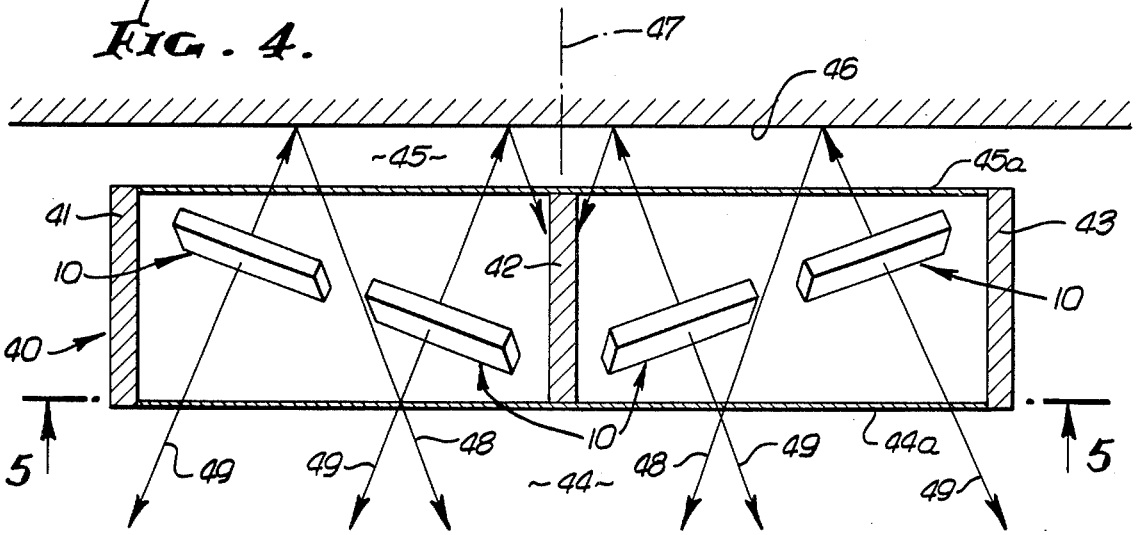
FIG. 4 is a horizontal section taken through a representative upright cabinet incorporating multiple speakers of the FIGS. 1 and 2 type.
Figure 5:
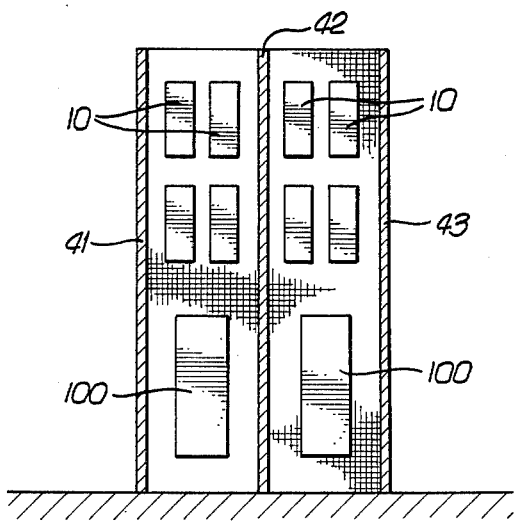
FIG. 5 is a reduced size frontal view of the FIG. 4 cabinet interior.

FIGS. 4 and 5 illustrate an application of multiple transducers or loudspeakers 10, as described. They are arranged in horizontally spaced pairs in a cabinet 40 having horizontally spaced uprights 41–43, the front 44 and rear 45 of the cabinet being acoustically open. Suitable fabric 44*a* and 45*a* covers the cabinet front and rear. Note that for best results the rear sides of the speakers facing wall 46 also are inclined to face toward a plane 47 extending in and rearwardly from the central upright. Sound waves directed rearwardly from the speakers are reflected by wall 46 to travel forwardly as indicated by paths 48. Note also forward paths 49 of sound waves from the speakers. The latter are also tilted slightly from vertical, as shown. Bass speakers appear at 100;

Loudspeakers incorporating the invention respond fully to frequences between 200 and 22,000 Hz, are inexpensive and provide high quality performance in terms of stability and reliability.

I claim:

1. In an electrostatic loudspeaker, the combination comprising (a) a pair of spaced, generally parallel diaphragms each of which includes a first sheet of plastic material and an electrically conductive layer adherent to said sheet, (b) a pair of frames respectively peripherally mounting said diaphragms, the frames extending in parallel, spaced apart relation, (c) a perforate, electrically conductive sheet sandwiched between said diaphragms, and (d) foraminous sheets of dielectric material sandwiched between said perforate sheet and said diaphragms, (e) whereby said diaphragms remain acoustically coupled through said foraminous dielectic sheets and through said perforate, electrically conductive sheet for simultaneous vibratory excursions when an AC signal is applied across said electrically conductive layers and said perforate sheet is connected to a common potential, (f) each diaphragm also including a second sheet of plastic material sandwiched between the electrically conductive layer and one of said foraminous sheets of dielectric material, said second sheet having the capacity to carry a larger permanent static charge than said first sheet, said first and second sheets consisting of different plastic materials.

2. The combination of claim 1 wherein each of said diaphragm first sheets comprises a polyester film of about 0.00025 inch thickness, the diaphragm periphery wrapped over one of said frames.

3. The combination of claim 1 wherein said second sheet is several times thicker than said first sheet.

4. The combination of claim 3 wherein the thickness of the first sheet is about 0.00025 inch, and the thickness of the second sheet is about 0.0015.

5. The combination of claim 1 including a transformer having a primary coil to which an AC signal is applicable and a secondary coil connected across said conductive layers, said perforate sheet connected to an intermediate tap associated with said secondary coil, there being a capacitance-diode network also connected with said perforate sheet, said network also effectively connected across said conductive layers.

6. The combination of claim 1 wherein each of said sheets of dielectric material consists of glass net in woven strand configuration.

7. The combination of claim 1 wherein the overall thickness of the glass net is about 0.0075 inches.

8. The combination of claim 1 including a tape bridging the peripheries of said frames, first sheets of plastic material, perforate electrically conductive sheet, and foraminous sheets of dielectric material, thereby to form a unitary transducer assembly therewith.

9. The combination that includes multiple loudspeakers as defined in claim 1, said loudspeakers arranged in horizontally spaced pairs in a cabinet having horizontally spaced uprights, the front and rear of the cabinet being acoustically open, said loudspeakers facing frontwardly and rearwardly.

10. The combination of claim 9 wherein the cabinet includes three of said uprights a first pair of the loudspeakers located between one side upright and an intermediate upright, and a second pair of the loudspeakers located between another side upright and said intermediate upright, the two pairs of speakers respectively facing rearwardly and toward a plane extending in and rearwardly from said intermediate upright.

11. In an electrostatic loudspeaker, the combination comprising (a) a pair of spaced, generally parallel diaphragms each of which includes a first sheet of plastic material and an electrically conductive layer adherent to said sheet, (b) a pair of frames respectively peripherally mounting said diaphragms, the frames extending in parallel, spaced apart relation, (c) a perforate, electrically conductive sheet sandwiched between said diaphragms, and (d) foraminous sheets of dielectric material sandwiched between said perforate sheet and said diaphragms, (e) whereby said diaphragms remain acoustically coupled through said foraminous dielectric sheets and through said perforate, electrically conductive sheet for simultaneous vibratory excursions when an AC signal is applied across said electrically conductive layers and said perforate sheet is connected to a common potential, (f) each diaphragm including a second sheet of plastic material sandwiched between the electrically conductive layer and one of said foraminous sheets of dielectric material, said first and second sheets peripherally wrapped about one of said frames, said second sheet is several times thicker than said first sheet, (g) said first sheet consisting of polyester film, and said second sheet consisting of vinylidene chloride film.

* * * * *